US010384904B2

(12) United States Patent
Hivatal

(10) Patent No.: US 10,384,904 B2
(45) Date of Patent: Aug. 20, 2019

(54) TAPE APPLICATOR WITH MAGNETIC ACTUATED BLADE GUARD

(71) Applicant: Intertape Polymer Corp., Sarasota, FL (US)

(72) Inventor: Endre Hivatal, Tampa, FL (US)

(73) Assignee: Intertape Polymer Corp., Sarasota, FL (US)

( * ) Notice: Subject to any disclaimer, the term of this patent is extended or adjusted under 35 U.S.C. 154(b) by 0 days.

(21) Appl. No.: 15/997,801

(22) Filed: Jun. 5, 2018

(65) Prior Publication Data

US 2018/0346276 A1 Dec. 6, 2018

Related U.S. Application Data

(60) Provisional application No. 62/515,298, filed on Jun. 5, 2017.

(51) Int. Cl.
*B65H 35/00* (2006.01)
*B65H 35/06* (2006.01)

(52) U.S. Cl.
CPC ..... *B65H 35/0033* (2013.01); *B65H 35/008* (2013.01); *B65H 35/06* (2013.01); *B65H 2407/10* (2013.01)

(58) Field of Classification Search
CPC ..... B65H 35/0013; B65H 35/0033; B65H 35/008; B65H 35/06; B65H 51/067; B65H 2407/10; B31B 3/00
See application file for complete search history.

(56) References Cited

U.S. PATENT DOCUMENTS 7,836,932 B2 * 11/2010 Lucht ..... B65H 35/0013 156/250
7,946,327 B2 * 5/2011 Fox ..... B65B 51/067 156/475
2007/0107825 A1 * 5/2007 Bredl ..... B65B 51/067 156/64
2009/0084504 A1 * 4/2009 Lam ..... B65B 51/067 156/538

* cited by examiner

*Primary Examiner* — Mark A Osele
*Assistant Examiner* — Christopher C Caillouet
(74) *Attorney, Agent, or Firm* — Moore & Van Allen PLLC; Jeffrey R. Gray

(57) ABSTRACT

A tape applicator including a main frame, and a knife arm assembly. The knife arm assembly may include a magnet mounted in a stationary position relative to the main frame, and a knife arm pivotally mounted to the main frame. A blade may be mounted to the knife arm. A guard may be rotationally connected to the knife arm and configured to rotate between a closed position covering the blade and an open position exposing the blade. A spring may bias the guard toward the closed position. A catch may be associated with the guard comprising ferromagnetic material. The catch may be attracted to the magnet to open the guard as the knife arm swings to a cutting position.

20 Claims, 11 Drawing Sheets

TAPE APPLICATOR WITH MAGNETIC ACTUATED BLADE GUARD

CROSS REFERENCE TO RELATED APPLICATIONS

This application claims the benefit of U.S. Provisional Application Ser. No. 62/515,298 filed on Jun. 5, 2017, the entire contents of which are hereby incorporated by reference.

FIELD OF THE INVENTION

The present invention relates to a tape head (tape applicator) for applying pressure sensitive adhesive tape to cartons, in particular a tape head having a magnetically actuated blade guard in a tape-cutting mechanism.

BACKGROUND OF THE INVENTION

Industrial tape heads, also known as tape applicators, employ a sharp blade for cutting pressure sensitive adhesive tape in the course of application to a case, such as a cardboard box or carton. OSHA standards require these blades to be covered except when the blade is ready to cut the tape.

Currently, industrial tape heads employ a blade guard that is biased by a torsion spring and a finger (or flag) protruding from the blade guard that follows the contour of the box. This finger is longer than the blade guard and provides a delay for the guard's closing, after the tape has been cut. One disadvantage to the use of the flag(s) to actuate the blade guard is the vulnerability of this projection to be broken if a carton becomes stuck in the carton sealing machine, especially if an operator pulls the carton out of the machine. Another disadvantage occurs when the carton to be sealed has a shallow profile. Here, a flag on an upper tape head and a flag on the lower tape head can interfere with one another. Furthermore, the flags can exert too much counter torque on the arms holding the blade, which creates increased cutting pressure. This increased pressure can contribute to the top flaps of the carton caving inward into the carton, which of course is undesirable. Accordingly, a tape head with a different mechanism for opening and closing a blade guard is needed.

SUMMARY

According to an embodiment, a tape applicator may include a main frame, and a knife arm assembly. The knife arm assembly may include a magnet mounted in a stationary position relative to the main frame. A knife arm may be pivotally mounted to the main frame. A blade may be mounted to the knife arm. A guard may be rotationally connected to the knife arm, and may be configured to rotate between a closed position covering the blade and an open position exposing the blade. The assembly may include a spring biasing the guard toward the closed position. A catch may be associated with the guard. The catch may include ferromagnetic material. The catch may be attracted to the magnet to open the guard as the knife arm swings to a cutting position.

One or more of the following features may be included. The spring biasing the guard toward the closed position may overcome the attraction between the catch and the magnet as the knife arm passes the cutting position. The knife arm assembly may be biased for pivotal movement between a taping position for applying a tape to a carton and the cutting position for cutting the tape after applying to the carton.

The magnet may be oriented at an angle in the range of 78° to 82° relative to a horizontal plane defined by a direction of tape application. The magnet may be elongate in a direction along the plane defined by the angle at which it is oriented. The catch may be movable along the magnet during a portion of a tape application process. The catch may include a tubular sleeve rotatable on a pin positioned within the guard. The catch may be rollable along the magnet during the portion of the tape application process. A magnetic flux of the magnet may move the guard to the open position after the catch separates from the magnet.

The blade may be releasably mounted to the knife arm. The knife arm may include an extension bracket defining an edge surface configured to contact a carton. The extension bracket may be releasably mountable to the knife arm in a plurality of positions along a length of the knife arm.

The tape applicator may further include a front applicator pivotally mounted to the main frame. The front applicator may be configured to apply a leading edge of a tape to a case. The tape application may include a rear applicator pivotally mounted to the main frame. The rear applicator may be configured to apply a trailing end of the tape to the case. The tape applicator may also include a plurality of rollers defining a pathway for the tape leading to the front applicator.

The guard may include a cleaning pad configured to contact the blade in the closes position. The cleaning pad may be configured to absorb one of a lubricant and a cleaning fluid.

According to another implementation, a tape applicator may include a main frame. A front applicator may be pivotally mounted to the main frame and may be configured to apply a leading edge of a tape to a case. A rear applicator may be pivotally mounted to the main frame and may be configured to apply a trailing end of the tape to the case. A plurality of rollers may be provided defining a pathway for the tape leading to the front applicator. The tape applicator may include a knife arm assembly. The knife arm assembly may include a magnet mounted in a stationary position relative to the main frame. A knife arm may be pivotally mounted to the main frame. A blade may be mounted to the knife arm. A guard may be rotationally connected to the knife arm, and may be configured to rotate between a closed position covering the blade and an open position exposing the blade. A spring may be provided biasing the guard toward the closed position. A catch may be associated with the guard. The catch may include ferromagnetic material. The catch may be attracted to the magnet to open the guard as the knife arm swings to a cutting position. The attraction of the catch to the magnet may be overcome by the spring biasing the guard toward the closed position as the knife arm passes the cutting position.

One or more of the following features may be included. The catch may be movable along the magnet during a portion of a tape application process. The catch may separate from the magnet as the knife arm swings to the cutting position. A magnetic flux of the magnet may move the guard to the open position after the catch leaves the magnet.

According to yet another embodiment, carton sealing machine may include a carton feeder configured to feed carton to be sealed in a first direction. The carton sealing machine may also include a tape applicator configured to apply a pressure sensitive tape to the carton. The tape applicator may include a main frame, and a knife arm assembly. The knife arm assembly may include a magnet mounted in a stationary position relative to the main frame.

A knife arm may be pivotally mounted to the main frame. A blade may be mounted to the knife arm. A guard may be rotationally connected to the knife arm and configured to rotate between a closed position covering the blade and an open position exposing the blade. A spring may be provided for biasing the guard toward the closed position. A catch may be associated with the guard. The catch may include a ferromagnetic material. The catch may be attracted to the magnet to open the guard as the knife arm swings to a cutting position to cut the pressure sensitive tape applied to the carton.

DETAILED DESCRIPTION

Figure 1:
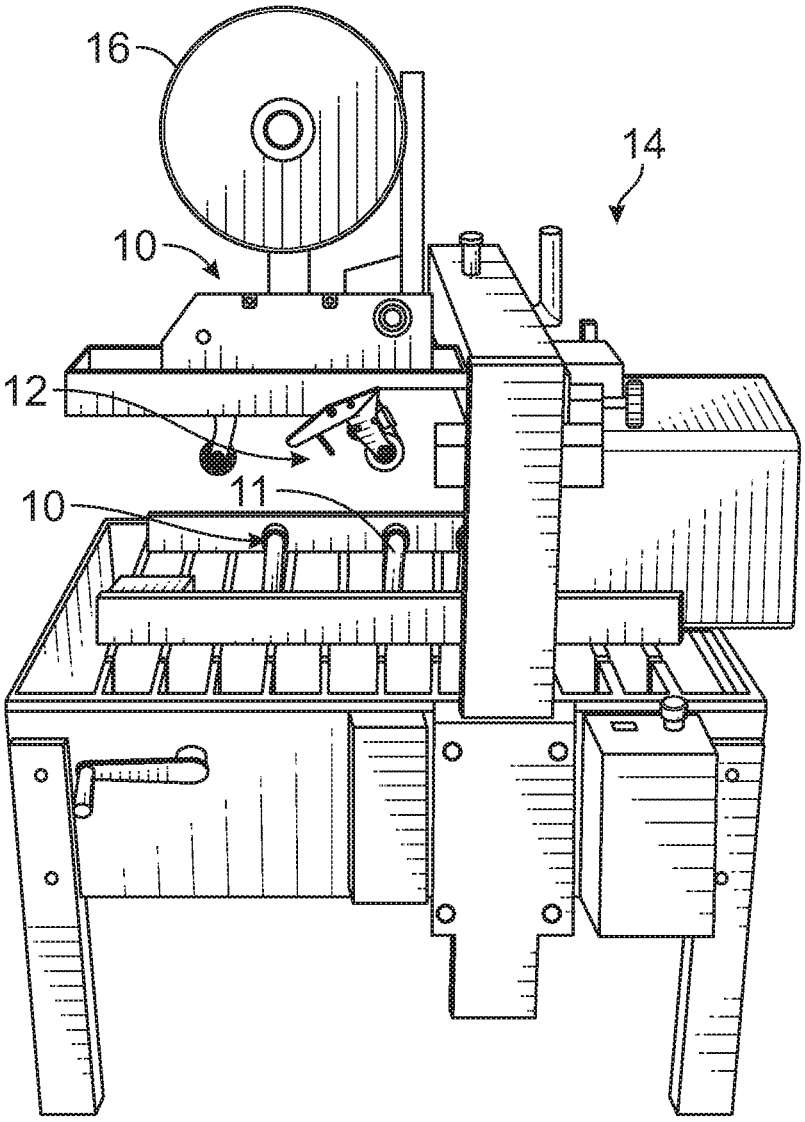
FIG. 1 is a photograph of a conventional carton sealing machine having an upper and a lower tape head (prior art) mounted therein.

The following detailed description will illustrate the general principles of the invention, examples of which are additionally illustrated in the accompanying drawings. In the drawings, like reference numbers indicate identical or functionally similar elements.

In general, the present disclosure may provide a tape applicator having a magnetically actuated blade guard. In some implementations, a tape applicator consistent with the present disclosure may include a tape applicator configured for applying a tape, such as a pressure sensitive adhesive tape, to a carton, e.g., for sealing and/or assembling the carton. In some embodiments, the tape applicator may include a cutting blade configured to swing, or pivot, into a web of tape, e.g., once a desired length of tape has been applied to a carton, in order to cut the tape. The blade may include a guard that is moveable between a closed position covering the blade (e.g., in a manner that may prevent or inhibit accidental contact between the blade and a user of the tape applicator) and an open position at least partially exposing the blade (e.g., to allow the blade to cut the tape). When the tape is to be cut, the blade may be pivoted through a range of motion, including a cutting position, in which the blade may cut the tape. Consistent with an embodiment of the present disclosure, a magnetic interaction may be utilized to move the guard to the open position when the blade is positioned (along the swinging path of the blade) to cut the tape. As the blade continues to travel through the range of motion, the magnetic interaction with the guard may be diminished, and the guard may be returned to the closed position. In some embodiments, the range of motion, and/or time, during which the guard moves from the closed position, to the open position (e.g., for cutting the tape), and then once again to the closed position may be relatively very small. As such, the blade may only be exposed for a very short range of motion and/or time, thereby reducing the likelihood of a user becoming injured by the exposed blade.

Consistent with the foregoing, in a particular embodiment, a tape applicator may include a main frame, and a knife arm assembly. The knife arm assembly may include a magnet mounted in a stationary position relative to the main frame. A knife arm may be pivotally mounted to the main frame and/or to a cover frame. A blade may be mounted to the knife arm. A guard may be rotationally connected to the knife arm, and may be configured to rotate between a closed position covering the blade and an open position exposing the blade. The assembly may include a spring biasing the guard toward the closed position. A catch may be associated with the guard. The catch may include ferromagnetic material. The catch may be attracted to the magnet to open the guard as the knife arm swings to a cutting position.

Turning to FIG. 1, common conventional tape applicators or tape heads 10 often include flags 11 extending from an arm 12 holding the blade, as shown mounted in the conventional manner in a carton sealing machine 14 in an upper position and again in a lower position. The tape heads 10 may often be removably mounted to the machine 14 to permit easy replacement of a depleted tape roll (a full tape roll 16 is shown) and to perform any required maintenance. In such conventional tape applicators, the flag(s) used to actuate the blade guard may be vulnerable to breakage if a carton becomes stuck in a carton sealing machine, especially if an operator pulls the carton out of the machine. Additionally, in the case of relatively shallow cartons, a flag on an upper tape head and a flag on the lower tape head can interfere with one another, and/or otherwise prove problematic.

Figure 2:
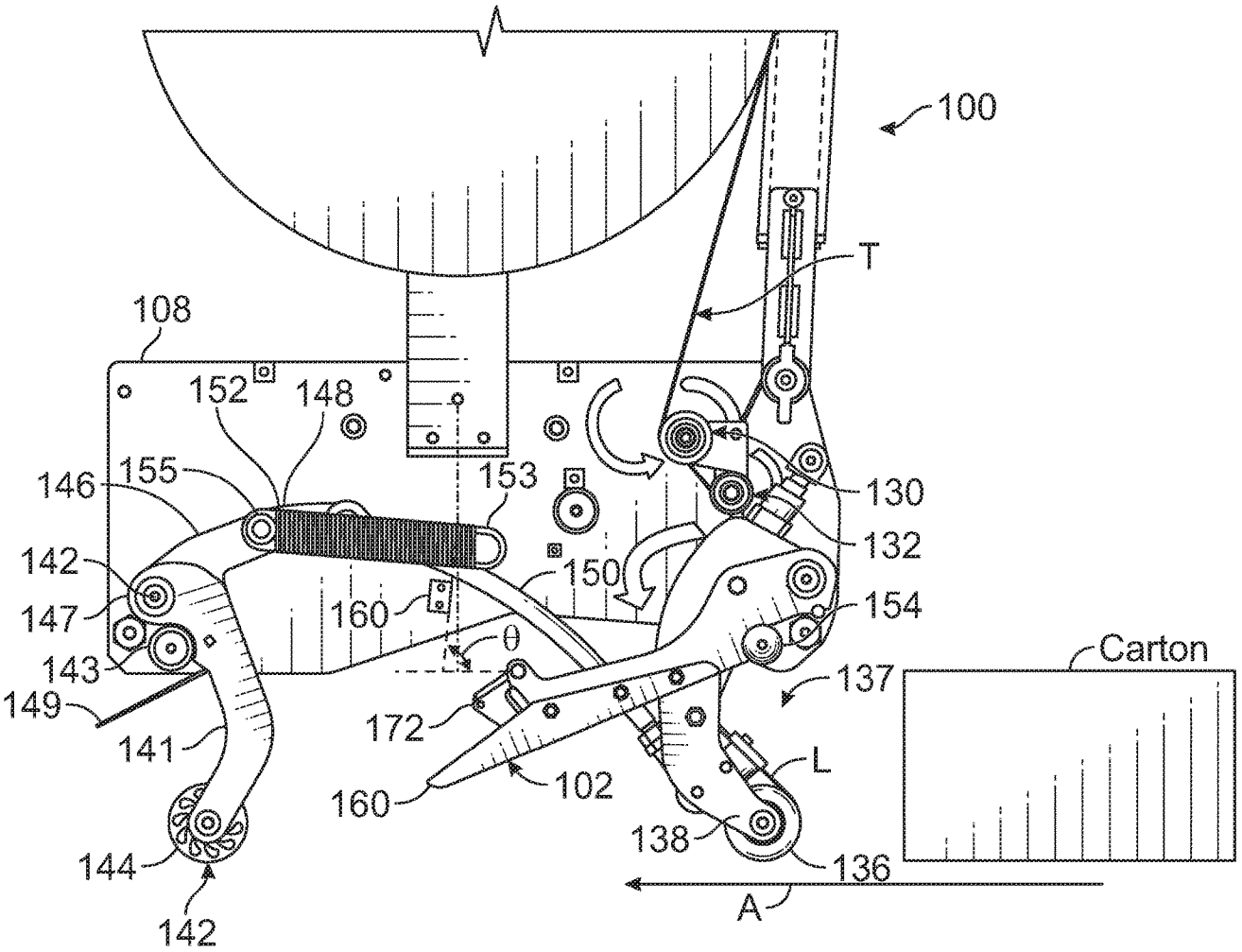
FIG. 2 is a side, plan view of an embodiment of a tape head with the cover frame removed.
Figure 3:
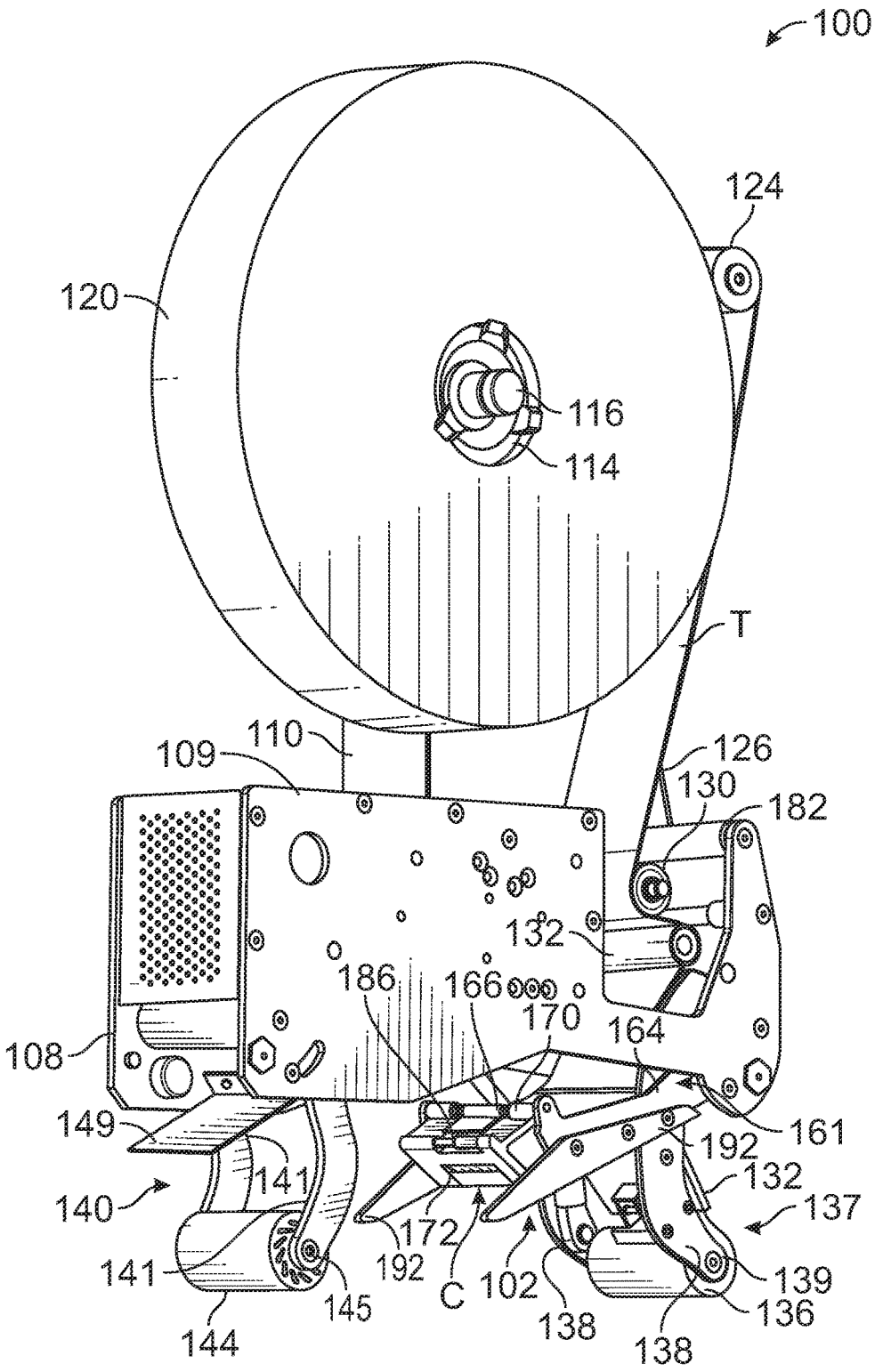
FIG. 3 is a perspective view of a tape head loaded with a roll of tape having a magnetically actuated tape-cutting mechanism.
Figure 4:
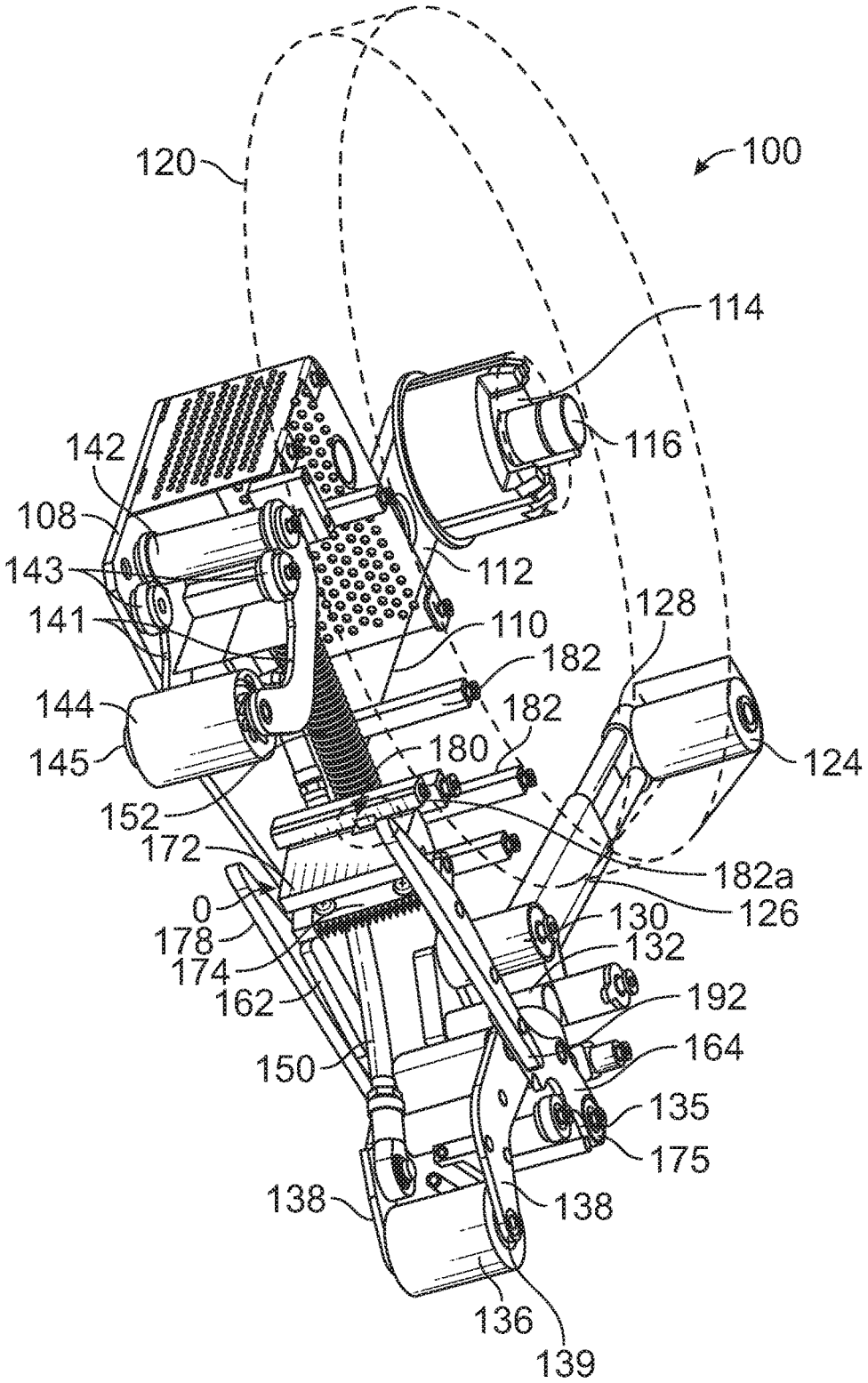
FIG. 4 is a bottom, perspective view of the tape head of FIG. 1 with the cover plate removed.

Turning now to FIGS. 2-4, an illustrative example tape head 100 (e.g., a tape applicator) is disclosed that includes an improved tape-cutting mechanism 102, in particular a magnetically actuated blade guard 172 protecting the blade 174 (e.g., which may provide protection against damage to the blade and/or provide protection against injury to a user by the blade), which operatively opens at the appropriate time and for the least amount of time needed to cut the pressure sensitive adhesive tape T during the tape application process. In the illustrative embodiment, the tape head 100 includes a main frame 108 on which the various operating parts of the tape head are mounted and a cover plate 109 protecting the various operating parts. The tape roll support arm 110 is mounted on and extends from the main frame 108 and has adjacent to its free end 112 a rotatable spindle or hub 114 mounted on a shaft 116 on which the tape roll 120 is mounted and from which a ribbon of tape T is dispensed along a tape path shown by the tape T.

In the illustrated tape head 100, the tape T passes over a peel-off roller 124 mounted on a dancer arm 126. The peel-off roller 124 may be positioned at or proximate a free end 128 of the dancer arm proximate the tape roll 120. The dancer arm 126 may be pivotably mounted to the main frame 108 and its free end 128 may be biased by a biasing member (not shown) toward the roll 120 to hold the peel-off roller 124 in contact with the periphery of the tape roll 120. The tape T may then extend over a clutch roller 130 and one or more guide rolls 132, and through a tape guide 134 (sometimes referred to as a tape shoe) to a front applicator roll 136 that applies a leading end L of the tape T to a carton (shown in FIG. 2) that is to be taped. In the illustrated tape head 100, the front applicator roll 136 and the tape guide 134 (or guide rolls in an alternate embodiment, not shown) are mounted on a front applicator arm 137, including opposing side arms 138 pivotally mounted to the main frame 108 as indicated at 135 in FIGS. 3 and 4. The front applicator roll 136 may rotatably mounted on the front applicator arm 137 proximate its free end 139 remote from the pivotal mount 135. It will be appreciated that various additional and/or alternative roller configurations may be implemented for directing the tape from a dispensing roll and orienting the tape for application to a carton.

Continuing with the illustrated tape head 100, a rear applicator arm 140, including opposing side arms 141, may be pivotably mounted to the main frame 108 on pivot mount 142. A rear applicator roll 144 may be rotatably mounted on the rear applicator arm 140 proximate its free end 145 remote from the pivotal mount 142. A push bar 146 and the rear applicator bar 140 may be mounted on a pivot mount 142 proximate the rear of the tape head 100, and a first end 148 of the push bar may be operatively connected to the front applicator arm 136 by linkage 150. A main spring 152 may extend generally parallel to the main frame 108 and may fixedly attached to the cover frame 109 at a first end 153 and to the push bar 146 at a second end 155 thereof to bias the front and rear applicator arms 136, 140 in concert to a receiving position ready to receive the next carton or box to be taped. The movement of the front and rear applicator arms 136, 140 may be limited by the presence of a stop, such as a rear bumper 143 positioned proximate the rear applicator arm 140. Downstream of the rear applicator arm 140, a wiper 149 may be positioned. It will be appreciated that the described front and rear applicators provide a possible arrangement for applying and adhering a tape along a desired expanse of a carton. It will be further appreciated that various additional and/or alternative arrangements for applying and adhering the tape to a carton may also be utilized without materially departing from the present disclosure.

Figure 5:
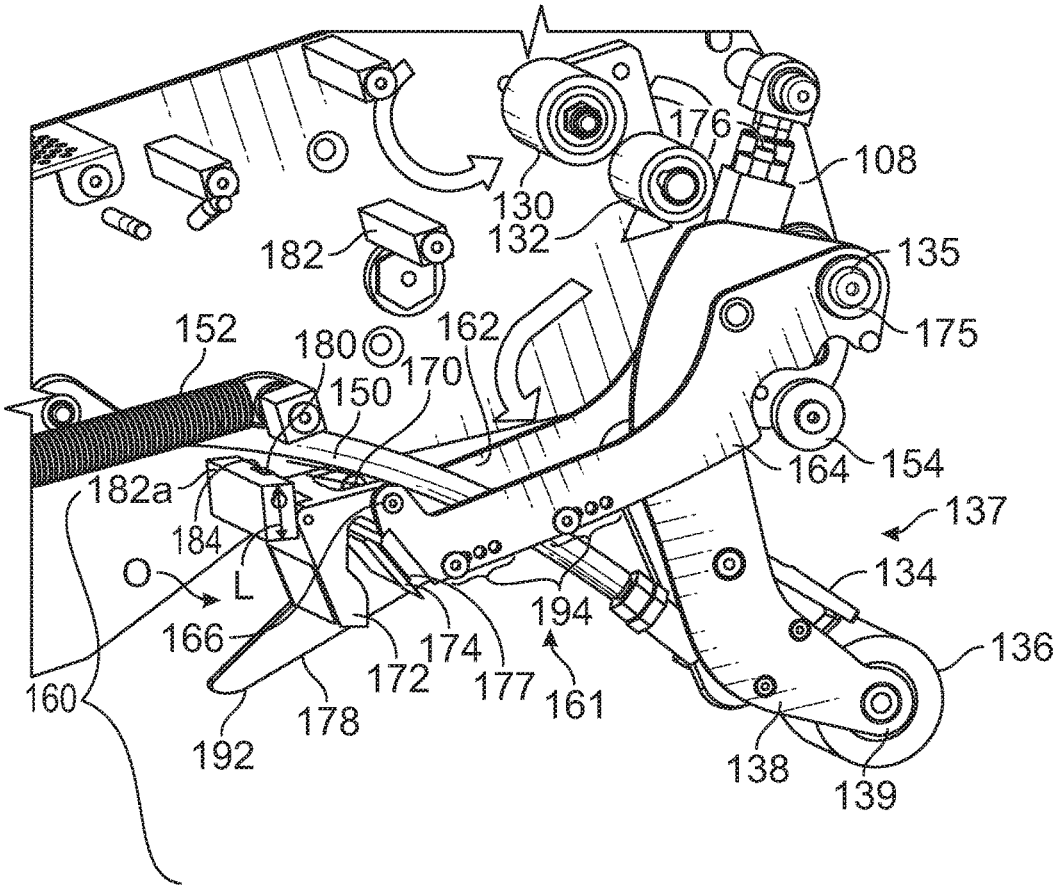
FIG. 5 is an enlarged, side perspective view of the tape-cutting mechanism with the left arm extension removed to provide more visibility of the blade and blade guard.

As generally discussed above, the present disclosure may provide a tape applicator (such as tape head 100) including a blade for cutting a tape applied to a carton, and a magnetically actuated blade guard for selectively exposing and covering or protecting the blade. Consistent with an illustrative example embodiment, an arrangement for severing an applied length of tape T after the tape has been applied to a carton moving in a tape application direction designated by arrow A in FIG. 2 may include a knife arm assembly 160. The knife arm assembly 160 may include parallel side plates 162 and 164, defining a knife arm 161. The side plates 162, 164 may be connected proximate their respective rear ends by shaft 166. Additionally, the side plates 162 and 164 may be connected to one another, and to the main frame 108 by pivotal mount 175, proximate the respective front ends of the side plates 162 and 164, as best seen in FIG. 5. The pivotal mount 175 may rotatably couple the side plates 162 and 164 to the main frame 108 and the cover frame 109. The side plates 162 and 164 may be spaced apart from one another to receive tape T therebetween. In particular the tape may be received between the side plates 162 and 164 after the tape has been applied to a carton by the front application roll 136. The movement of the knife arm assembly 160 (e.g., pivotal movement relative to the main frame 108) may be limited by a stop, such as front bumper 154. Consistent with the illustrative embodiment, the shaft 166 may also support a spring 170 that may bias a blade guard 172 to a closed position "C" over a blade 174. In such an arrangement, both the guard 172 and the blade 174 pivotally move with the knife arm assembly 160 relative to the main frame 108.

Figure 6:
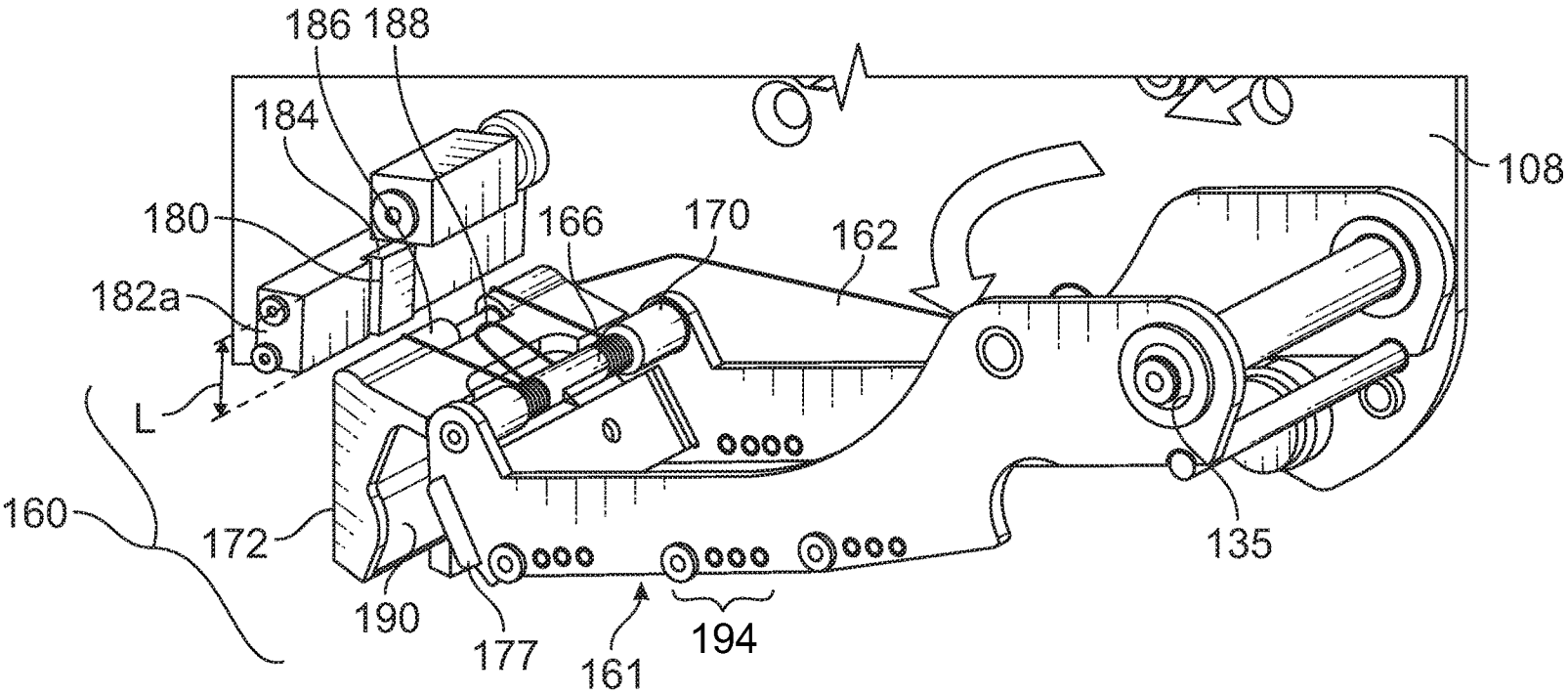
FIG. 6 is a perspective, side view showing the blade guard fully open.

As generally discussed, the guard may be magnetically actuated, e.g., to move the guard between the opened and closed positions. For example, in the illustrated embodiment, the knife arm assembly 160 may include a magnet 180 mounted in a stationary position relative to the main frame 108. As best shown in FIG. 6, the magnet 180 may be provided as part of, and or attached to, one of the cross bars 182 between the main frame 108 and the cover frame 109, which will be referred to as the magnetic cross bar 182*a*. The magnetic cross bar 182 may be positioned to place the magnet 180 at a position proximate guard 172 to interact with a catch 186 that is part of the guard 172, in at least some positions of the knife arm 161. As will be discussed in greater detail below, the catch 186 may include a feature that may experience a magnetic attraction with the magnet 180. Accordingly, the relative positioning of the magnet 180 and the catch 186 (e.g., which may be part of, and/or associated with, the guard 172) may allow the magnet 180 and the catch 186 to be operatively attracted in at least some positions of the knife arm 161 to move the guard 172 to the open position to expose the blade 174 to the tape T at the time cutting of the tape is desired. The operative attraction between the magnet 180 and the catch 186 may be released in other positions of the knife arm 161 to allow the guard 172 to be moved to the closed position covering the blade 174.

In various embodiments, the magnet 180 may be seated in a recess 184 in the cross bar 182*a*, may be integral with the cross bar 182*a*, or may be mounted to an exterior surface of the cross bar 182*a*. In the illustrated embodiment, as most clearly seen in FIG. 6, the magnet 180 may be elongate with its length L oriented as shown in FIG. 2. The orientation of the magnet 180 may be at an angle θ in the range of 78° to 82° relative to a horizontal plane defined by the top of a carton passing under or over a tape head 100 in the direction of tape application A. In one embodiment, the angle θ may be 80° from the horizontal plane defined by the top of the carton. It will be appreciated that other angular arrangements may also be employed depending upon the exact configuration of the tape head 100. In some embodiments, the length L of the magnet 180, identified in FIGS. 5 and 6, which may include a dimension in a direction along the plane defined by the angle at which the magnet 180 is oriented, may be in a range of 5 mm to 30 mm. In one embodiment, the magnet is 16 mm by 16 mm by 3.2 mm. Various suitable magnets may be utilized, including, for example, a rear earth magnet, such as, but not limited to, a neodymium magnet that may be nickel plated. In some embodiments, the magnet 180 may have a pull force equal to, or greater than, 26 newton, according to the manufacturer's specification, with enough of a magnetic field to perform in operation as explained below. However, and keeping with the description herein, it will be appreciated that the magnetic pull required to perform the operations herein may vary depending upon the exact configuration of the tape head 100 (e.g., including clearances between the magnet and the catch, the range and geometries of motion of the knife arm 161, the materials of the catch, etc.). Suitable magnets are available from McMaster-Carr, Cleveland, Ohio.

The knife assembly may include blade 174 mounted to the knife arm 161 via bracket 177 or other suitable mounting configuration. The blade 174 may be releasably mounted, e.g., by screws, bolts, or the like, to allow replacement of the blade 174. As described above, the blade 174 may protected by the guard 172 in at least some positions of the guard and/or the knife arm 161. The guard may be rotationally connected to the knife arm 161 upon shaft 166, thereby allowing the guard 172 to rotate between a closed position "C" at least partially covering the blade 174 and an open position "O" at least partially exposing the blade 174 (e.g., relative to the tape to be cut). As noted above, a spring 170, such as a torsion spring and/or other biasing member, may be provided biasing the guard 172 toward the closed position "C". As shown in the illustrated embodiment, the spring 170 may include a double torsion spring, however other spring configurations may equally be utilized for biasing the guard toward the closed position.

As described above, consistent with the illustrated embodiment the knife arm assembly 160 may include a catch 186 associated with the guard 172. This catch 186 may be attracted to the magnet 180, in at least some positions of the knife arm 161, to urge the guard 172 to the open position as the knife arm 161 swings to a cutting position. The catch 186 may be movable along the magnet 180 during a portion of the tape application process (e.g., throughout at least a portion of the range of motion of the knife arm 161). In general, the catch 186 may include a feature integrally formed with the guard, at least partially embedded within the guard, and/or attached to the guard. With reference to FIGS. 2-7, in the illustrated example embodiment, the catch 186 may include a tubular sleeve formed from a ferromagnetic material seated on a dowel pin 188 within the guard 172. As a tubular sleeve seated on the dowel pin 188, the catch may be capable of rotation on the dowel pin 188 during movement of the catch 186 along the magnet 180 during a portion of the tape application process (e.g., during at least a portion of the range of motion of the knife arm 161). As such, the catch 186 may be rollable along the magnet 180 during a portion of the tape application process (e.g., during at least a portion of the range of motion of the knife arm 161). Through the range of motion of the knife arm 161 from a position rotated toward the main frame 108 toward a position rotated away from the main frame 108, the catch 186 may travel (e.g., roll along) the length L of the magnet 180 in a direction toward a carton and may separate from the magnet 180. As the catch 186 separates from the magnet 180, the magnetic field of the magnet 180 exert a pull on the catch (e.g., by virtue of the magnetic attraction with the catch 186), and which may move the guard 172 to the open position "O", shown in FIGS. 4-6. In one embodiment, the catch 186 is a ferromagnetic chrome plated tubular sleeve. However, it will be appreciated that the catch 186 may include other materials that may exhibit an operative magnetic attraction with magnet 180, including other ferromagnetic materials, another magnet, and the like. Additionally, it will be appreciated that while the example embodiment has been described have an arrangement in which the magnet may be mounted in a stationary position relative to the main frame, and the catch may be associated with the guard, in other embodiments, the magnet may be associated with the guard, and a catch providing operative magnetic attraction may be mounted in a stationary position relative to the main frame.

As generally indicated above, the knife arm assembly 160 may include knife arm 161 that may be rotatably mounted relative to the main frame 108. In particular, the knife arm 161 may be capable of rotating between a position adjacent the main frame 108 (e.g., with the knife arm 161 rotated in toward the main frame 108) and a position spaced from the main frame (e.g., with the knife arm 161 rotated out from the main frame 108). During a taping process, a carton may move under (or over) the tape head 100, e.g., via a suitable conveyer, roller, or other feed mechanism. During such a taping process, the knife arm 161 may be biased away from the main frame 108, and into contact with the carton being taped. Accordingly, as the carton is fed passed the tape head 108, the knife arm 161 may be pushed toward a position adjacent to the main frame 108 by the carton. As the carton passes 161 the tape head, the knife arm 161 may no longer be in contact with the carton, and the biasing force and the knife arm 161 may cause the knife arm 161 to rotate to a position further away from the main frame 108 (e.g., further away from the main frame 108 than when the carton was restricting rotational movement of the knife arm 161).

Turning to FIG. 5, in the illustrated embodiment, the knife arm assembly 160 may include a compression spring 176. The compression spring 176 may be adjustable to increase or decrease the biasing force toward a carton, and may be connected to at least one of the side plates 162, 164. In particular, the illustrated compression spring 176 may be adjusted to bias the knife arm assembly 160 to a normal position placing edge surfaces 178 of the side plates 162, 164 that face a carton into direct contact with the carton, which will trace along the carton as the carton passes through a carton sealing machine. In some embodiments, the knife arm 161, on each of the side plates 162, 164, may include an extension 192 defining the edge surface 178 that contacts a carton. In some embodiments, the extensions 192 may be releasably mountable to the side plates 162, 164, e.g., which may allow positioning of the extensions in one or more of a plurality of positions 194 along the length thereof of the side plates 162, 164. These plurality of positions may provide de facto timing positions for the cut of the tape, dependent on carton speed. That is, and as will be described in greater detail below, when the carton moves passed the knife arm 161 (e.g., passed the end of the extensions 192), the knife arm 161 may rotate away from the main frame 108 (e.g., as the knife arm 161 may no longer be blocked from such rotation by the carton). During the rotation of the knife arm 161 away from the main frame 108, the interaction between the magnet 180 and the catch 186 may temporarily move the guard 172 to the open position, exposing the blade 174 for cutting the tape.

Continuing with the foregoing, in operation, the knife arm assembly 160 may follow the top or bottom of a carton (depending upon the orientation of the tape head 100 relative to the carton), and the catch 186 may be attracted to the magnet 180 and may roll to an equilibrium position (e.g., based upon, at least in part, a position of the knife arm 161, and thereby a position of the catch 186 relative to the magnet 180). When the extensions 192 of the knife arm 161 reach the trailing edge of the carton, the cutting may be initiated and the knife arm 161, and hence the blade 174, swings toward the tape T (e.g., during rotation away from the main frame 108). Initially, during the rotation of the knife arm 161 away from the main frame 108 (and toward the tape T), the blade guard 172 may move in unison with the blade 174, with the catch 186 rolling down the surface of the magnet 180. As the catch 186 rolls down the surface of the magnet 180, away from the equilibrium position, the attraction between the catch 186 and the magnet 180 may begin to separate the blade guard 172 from the blade 174 because they will follow slightly different angled paths. After some degree of travel (e.g., about a centimeter of travel in an illustrative embodiment), the catch 186 may reach the edge of the magnet 180. The knife arm 161 may continue to move in the cutting direction (e.g., rotate away from the main frame 108), and the catch 186 may separate from the magnet 180. However, the magnetic flux of the magnet 180 may continue to attract the catch 186, which swings the blade guard 172 open to expose the blade 174 to cut the tape T. As the knife arm 161 continue to rotate away from the main frame 108, the guard 172 and catch 186 may also rotate away from the magnet 180. Once the catch 186 is sufficiently out of the magnetic flux, the attraction between the catch 186 and the magnet 180 may decrease to the point that the biasing force of the torsion spring 170 may overcome the attraction between the catch 186 and the magnet 180. Once the torsion spring 170 overcomes the attraction between the catch 186 and the magnet 180, the torsion spring 170 may bias the blade guard 172 to its closed position C covering the blade 174. In some implementations, this action in operation may be so quick that it may be virtually undetectable to the naked eye. For example, in an experimental implementation, a high speed camera was required to see the blade guard in the open position. Based upon, at least in part, the length of extensions 192, a length of tape may be provided extending from the trailing edge of the carton. The length of tape extending beyond the edge of the carton may will thereafter be applied to the trailing surface of the carton by the rear applicator roll 144.

Figure 8A:
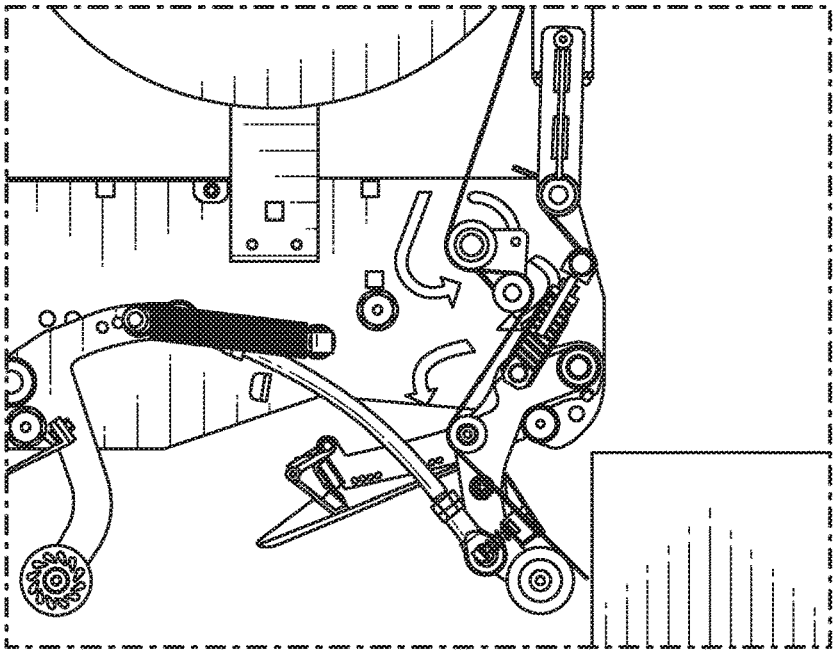
FIGS. 8A-8G are selected illustrations of the tape head passing over a carton to show the cutting step.
Figure 8B:
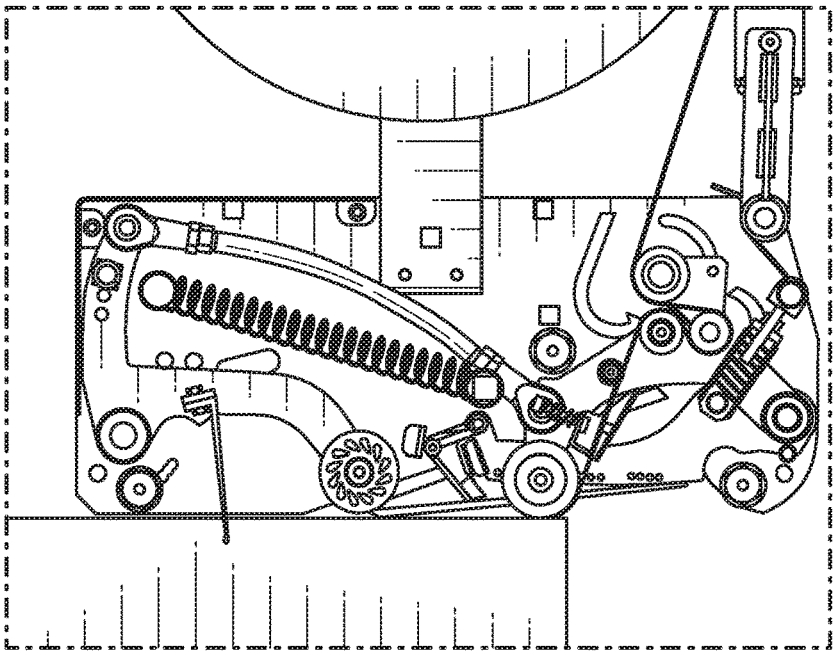
Figure 8C:
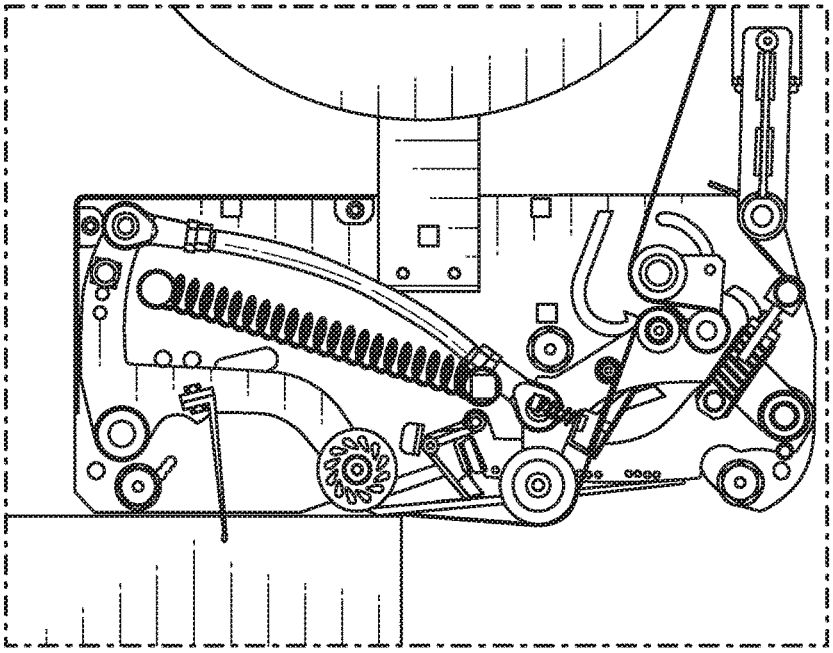
Figure 8D:
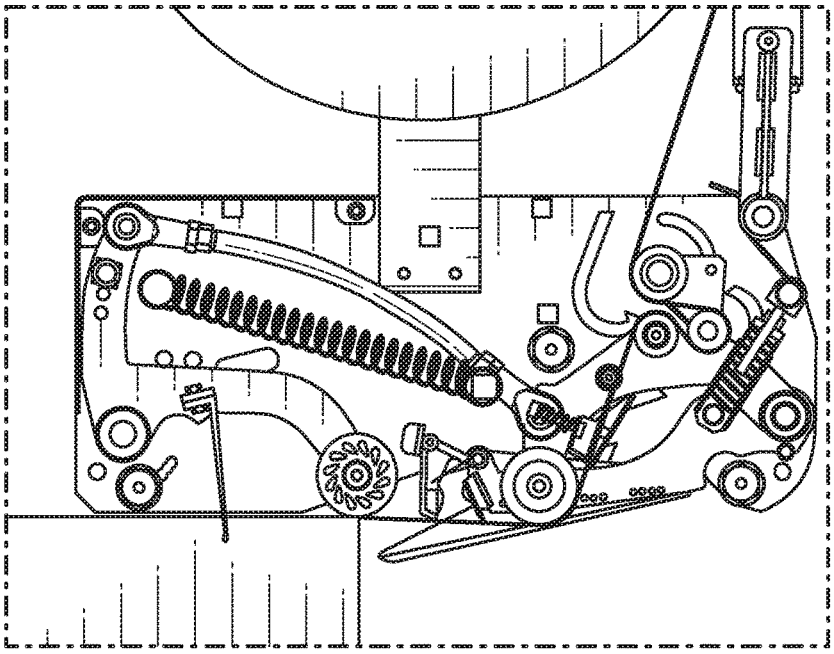
Figure 8E:
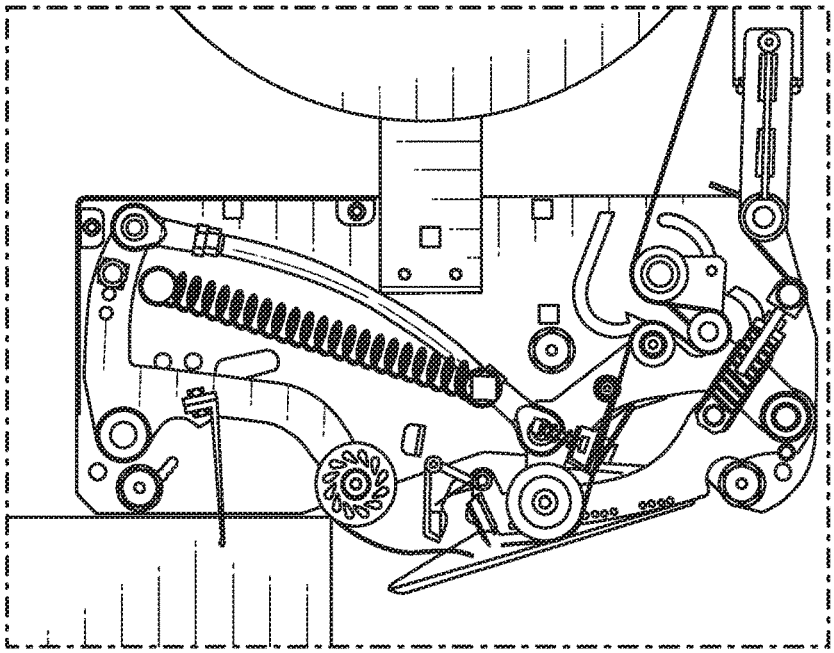
Figure 8F:
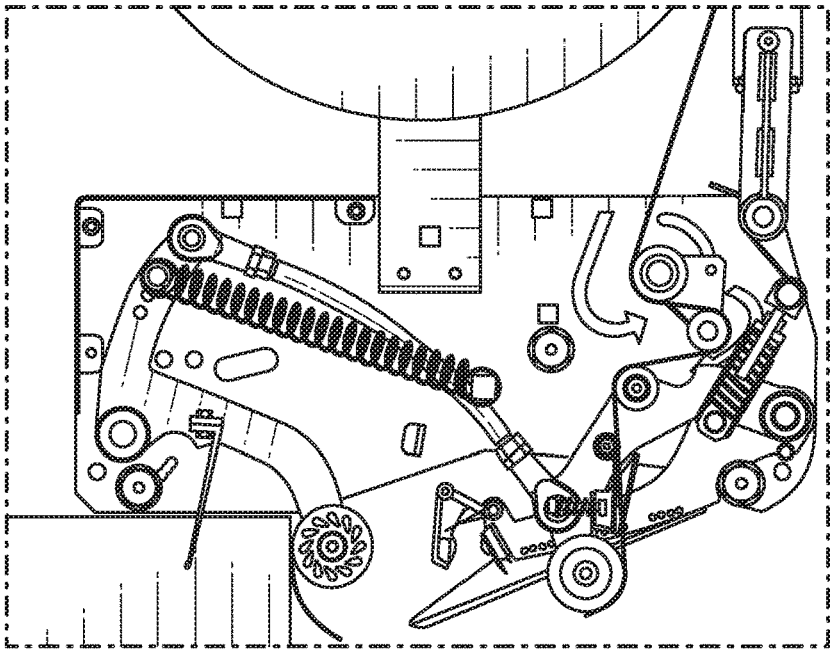
Figure 8G:
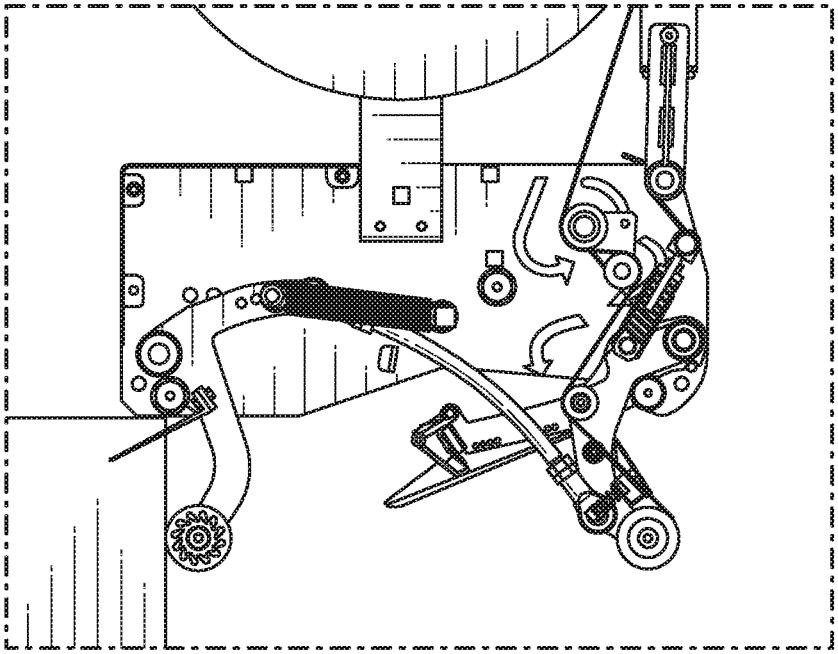

For example, and referring to FIG. 8A, as the carton moves to engage the tape head 100, the front applicator roll may engage a side of the leading edge of the carton to begin applying the tape T to the carton. As the carton continues to move past the tape head, the knife arm may be rotated toward the main frame, e.g., as a result of the contact between the extensions and the top of the carton, as shown in the illustrated example of FIG. 8B. As shown the extensions of the knife arm may ride along the carton, e.g., generally maintaining the position of the knife arm rotated toward the main frame. With the extensions riding along the carton, the catch may be held in an equilibrium position relative to the magnet, and the guard may be in the closed position relative to the blade. Referring to FIGS. 8C and 8D, as the tape head move past the trailing edge of the carton, the extensions of the knife arm may move beyond the trailing edge of the carton. Once the extensions of the knife arm clear the trailing edge of the carton, the knife arm may be freed to rotate away from the main frame under the biasing force of the compressing spring acting on the knife arm. With particular reference to FIG. 8D, as the knife arm rotates away from the main frame, the magnet may continue to attract the catch. The continued movement of the knife arm away from the main frame, in conjunction with the attraction between the catch and the magnet, may move the guard to the open position, at least partially exposing the blade. With the blade at least partially exposed, and as a result of the movement of the knife arm away from the main frame, the blade may contact the tape, allowing the blade to cut the tape. As shown in FIG. 8E, as the tape is cut by the blade, and the knife arm continues to rotate away from the main frame, the catch may separate from the magnet (e.g., due to an increasing spring force of the torsion spring urging the guard toward the closed position and/or the guard reaching an end range of motion relative to the knife arm, due to a stop or other physical constriction). For at least a portion of the travel of the guard away from the magnet (i.e., at least a portion of the separation of the catch from the magnet), the magnetic attraction may maintain the guard in the open position. However, as the separation increases the attraction may decrease, and may be overcome by the spring force urging the guard to the closed position. Referring also to FIG. 8F, once the spring force overcomes the magnetic attraction, the guard may be returned to the closed position relative to the blade under the biasing force of the spring. As discussed above, when the guard is in the closed position, the blade may be at least partially covered by the guard, e.g., so as to prevent inadvertent contact with the blade. Additionally, as shown in FIG. 8F, as the carton continues to move past the tape head, the rear applicator roller may follow the end of the carton at the trailing edge of the carton, thereby adhering the tape down at least a portion of the end of the carton.

Consistent with some embodiments, the geometries, spring forces, and/or ranges of motion of the rollers, the knife arm and the guard may be selected to achieve a desired trailing length of tape, and to minimize the length of time that the blade is exposed (e.g., the length of time the guard is in the open positon). Additionally, it will be appreciated that, consistent with various embodiments of the present disclosure, the tape head may be stationary and the carton may move relative to the tape head (e.g., on a conveyer, roller bed, etc.), the carton may be stationary, and the tape head may move relative to the carton, and/or both the carton and the tape head may move relative to one another to effectuate the application of tape to the carton by the tape head.

Figure 7:
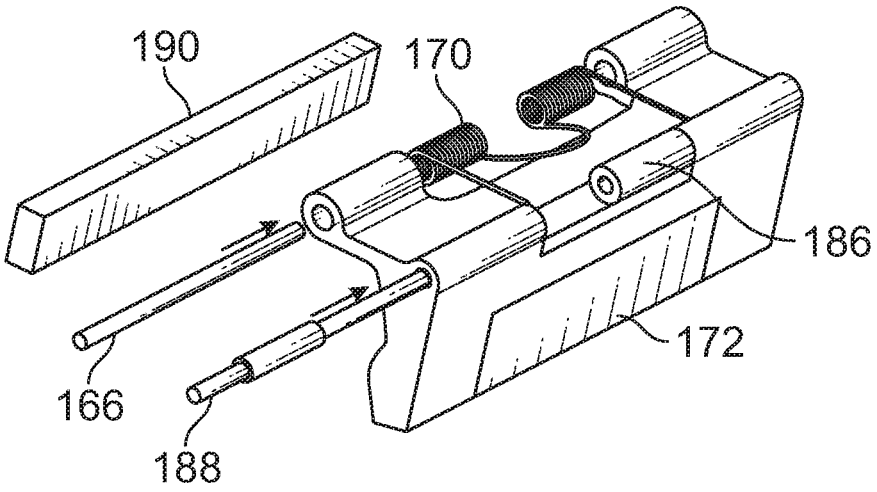
FIG. 7 is a exploded view of the blade guard assembly.

As shown in FIGS. 6 and 7, in some embodiments, the guard 172 may include a strip of material (pad) 190 facing the blade 174, which may come into contact with the blade 174 when the guard is in the closed position C. The strip of material 190 may be absorbent with respect to an oil, lubricant, cleaning fluid, or the like. Thus, when the guard 172 rapidly returns to the closed position, the strip of material may contact, or "wipe", the cutting edge of the blade 174 each time the blade cuts through the tape T. The coating of the cutting edge with a lubricant or cleaning fluid may prevent or reduces buildup of the pressure sensitive adhesive on the cutting edge that might interfere with the operation of the tape applicator.

Having described the invention in detail and by reference to preferred embodiments, it will be apparent that modifications and variations thereof are possible without departing from the scope of this invention. The tape is preferably a pressure sensitive adhesive tape, but is not limited thereto.

What is claimed:

1. A tape applicator comprising:

a main frame; and a knife arm assembly comprising:

a magnet mounted in a stationary position relative to the main frame;

a knife arm pivotally mounted to the main frame;

a blade mounted to the knife arm;

a guard rotationally connected to the knife arm and configured to rotate between a closed position covering the blade and an open position exposing the blade;

a spring biasing the guard toward the closed position; and a catch associated with the guard comprising ferromagnetic material;

wherein the catch is attracted to the magnet to open the guard as the knife arm swings to a cutting position.

2. The tape applicator according to claim 1, wherein the spring biasing the guard toward the closed position overcomes the attraction between the catch and the magnet as the knife arm passes the cutting position.

3. The tape applicator according to claim 1, wherein the knife arm assembly is biased for pivotal movement between a taping position for applying a tape to a carton and the cutting position for cutting the tape after applying to the carton.

4. The tape applicator according to claim 1, wherein the magnet is oriented at an angle in the range of 78° to 82° relative to a horizontal plane defined by a direction of tape application.

5. The tape applicator according to claim 4, wherein the magnet is elongate in a direction along the plane defined by the angle at which it is oriented.

6. The tape applicator according to claim 4, wherein the catch is movable along the magnet during a portion of a tape application process.

7. The tape applicator according to claim 6, wherein a magnetic flux of the magnet moves the guard to the open position after the catch separates from the magnet.

8. The tape applicator according to claim 4, wherein the catch includes a tubular sleeve rotatable on a pin positioned within the guard.

9. The tape applicator according to claim 8, wherein the catch is rollable along the magnet during the portion of the tape application process.

10. The tape applicator according to claim 1, wherein the blade is releasably mounted to the knife arm.

11. The tape applicator according to claim 1, wherein the knife arm comprises an extension bracket defining an edge surface configured to contact a carton.

12. The tape applicator according to claim 11, wherein the extension bracket is releasably mountable to the knife arm in a plurality of positions along a length of the knife arm.

13. The tape applicator according to claim 1, further comprising:

a front applicator pivotally mounted to the main frame and configured to apply a leading edge of a tape to a case;

a rear applicator pivotally mounted to the main frame configured to apply a trailing end of the tape to the case; and a plurality of rollers defining a pathway for the tape leading to the front applicator.

14. The tape applicator according to claim 1, wherein the guard comprises a cleaning pad configured to contact the blade in the closed position.

15. The tape applicator according to claim 14, wherein the cleaning pad is configured to absorb one of a lubricant and a cleaning fluid.

16. A tape applicator comprising:

a main frame, a front applicator pivotally mounted to the main frame and configured to apply a leading edge of a tape to a case;

a rear applicator pivotally mounted to the main frame configured to apply a trailing end of the tape to the case;

a plurality of rollers defining a pathway for the tape leading to the front applicator; and a knife arm assembly comprising:

a magnet mounted in a stationary position relative to the main frame;

a knife arm pivotally mounted to the main frame;

a blade mounted to the knife arm;

a guard rotationally connected to the knife arm configured to rotate between a closed position covering the blade and an open position exposing the blade;

a spring biasing the guard toward the closed position; and a catch associated with the guard comprising ferromagnetic material;

wherein the catch is attracted to the magnet to open the guard as the knife arm swings to a cutting position; and wherein the attraction of the catch to the magnet is overcome by the spring biasing the guard toward the closed position as the knife arm passes the cutting position.

17. The tape applicator according to claim 16, wherein the catch is movable along the magnet during a portion of a tape application process.

18. The tape applicator according to claim 17, wherein the catch separates from the magnet as the knife arm swings to the cutting position.

19. The tape applicator according to claim 18, wherein a magnetic flux of the magnet moves the guard to the open position after the catch leaves the magnet.

20. A carton sealing machine comprising:

a carton feeder configured to feed carton to be sealed in a first direction; and a tape applicator configured to apply a pressure sensitive tape to the carton, the tape applicator comprising:

a main frame; and a knife arm assembly comprising:

a magnet mounted in a stationary position relative to the main frame;

a knife arm pivotally mounted to the main frame;

a blade mounted to the knife arm;

a guard rotationally connected to the knife arm and configured to rotate between a closed position covering the blade and an open position exposing the blade;

a spring biasing the guard toward the closed position; and a catch associated with the guard comprising ferromagnetic material;

wherein the catch is attracted to the magnet to open the guard as the knife arm swings to a cutting position to cut the pressure sensitive tape applied to the carton.

* * * * *